US006027309A

United States Patent [19]

Rawls et al.

[11] Patent Number: 6,027,309

[45] Date of Patent: Feb. 22, 2000

[54] FREE-STANDING OVERHEAD FAN APPARATUS

[76] Inventors: Ronald Wayne Rawls; Peggy Nell Rawls, both of P.O. Box 1580, Hemphill, Tex. 75948; John William Cook, Jr.; Joan Marie Cook, both of 6426 Field Knoll, Garland, Tex. 75043

[21] Appl. No.: 09/039,946

[22] Filed: Mar. 16, 1998

[51] Int. Cl.[7] ..... A45B 23/00

[52] U.S. Cl. ..... 416/5; 416/142; 416/146 R; 416/170 R; 248/519; 248/523; 248/529; 417/326

[58] Field of Search ..... 416/5, 142, 146 R, 416/170 R, 246, 244 R, 210 R; 248/519, 523, 529; 417/326, 411, 423.1, 424.1

[56] References Cited

U.S. PATENT DOCUMENTS

| | | | |
|---|---|---|---|
| 5,007,811 | 4/1991 | Hopkins | 135/16 |
| 5,114,016 | 5/1992 | Todd | 211/26 |
| 5,172,711 | 12/1992 | Mueller et al. | 135/16 |
| 5,273,062 | 12/1993 | Mozdzanowski | 135/16 |
| 5,273,402 | 12/1993 | Maury | 416/246 |
| 5,349,975 | 9/1994 | Valdner | 135/16 |
| 5,711,331 | 1/1998 | Harris | 135/16 |
| 5,725,356 | 3/1998 | Carter | 416/240 |

OTHER PUBLICATIONS

Fanimation, "A–Z Vacuum & Fan Showroom," Website http://www.fans–tastic.com/fanimation.asp, May 15, 1998.

*Primary Examiner*—Edward K. Look
*Assistant Examiner*—Matthew T. Shanley
*Attorney, Agent, or Firm*—David H. Judson

[57] ABSTRACT

A free-standing overhead fan apparatus includes a stand and a fan mounted on the stand. The stand includes a base positioned on ground level and an elongated member extending upwardly from the base. The fan is mounted at the upper end of the elongated member, preferably about seven feet above ground level. The fan includes a housing containing an electric motor and a rotating shaft extending from the motor. The fan also includes fan blades radially extending from the motor shaft. The fan is mounted on the stand such that the motor shaft and fan blades are rotatable about a vertical axis to emulate a ceiling fan.

18 Claims, 8 Drawing Sheets

FREE-STANDING OVERHEAD FAN APPARATUS

BACKGROUND OF THE INVENTION

1. Technical Field

The present invention relates generally to fans for creating air currents and, more particularly, to a free-standing overhead fan.

2. Description of the Related Art

Ceiling fans are widely used to increase air circulation in rooms. The fans, which are fixedly mounted on ceilings, usually have three or four fan blades that are rotated by an electric motor. The fans create downward or upward air currents and are able to very efficiently circulate air in large spaces.

Ceiling fans promote energy conservation by allowing more effective circulation of heated and cooled air from heating and air conditioning units. Also, by themselves, ceiling fans provide a pleasant breeze having a cooling effect in warm weather.

Ceiling fans are preferred over portable fans that blow air horizontally across spaces because ceiling fans provide a more uniform and gentle breeze. Ceiling fans are also able to more effectively circulate air over large spaces.

One significant disadvantage of ceiling fans is that they are not portable and cannot be readily moved to provide air circulation elsewhere. In addition, they are impractical in places having very high ceilings such as, for example, atriums of hotels and office buildings. Ceiling fans also, of course, cannot be used in the outdoors since there is no place to mount the fans.

Thus a need exists for a portable, free-standing fan that provides the advantages of a ceiling fan.

BRIEF SUMMARY OF THE INVENTION

One object of the present invention to provide a fan apparatus that provides the advantages of a ceiling fan, but does not require a ceiling on which to be mounted.

Another object of the invention is to provide a fan apparatus that is portable.

These and other objects are accomplished by a free-standing overhead fan apparatus in accordance with the invention. The fan apparatus includes a stand and a fan mounted on the stand. The stand includes a base positioned on ground level and an elongated member extending upwardly from the base. The fan is mounted at the upper end of the elongated member, preferably about seven feet above ground level. This distance has been found to be suitable for limiting human contact for safety reasons, yet providing effective air flow to users of the device.

The fan includes a housing containing an electric motor and a rotating shaft extending from the motor. The fan also includes fan blades radially extending from the motor shaft. The fan is mounted on the stand such that the motor shaft and fan blades are rotatable about a vertical axis to emulate a ceiling fan.

BRIEF DESCRIPTION OF THE DRAWINGS

For a more complete understanding of the present invention and the advantages thereof, reference should be made to the following Detailed Description taken in connection with the accompanying drawings in which.

Like reference numerals denote like parts in the drawings.

DETAILED DESCRIPTION OF THE PREFERRED EMBODIMENT

Figure 1:
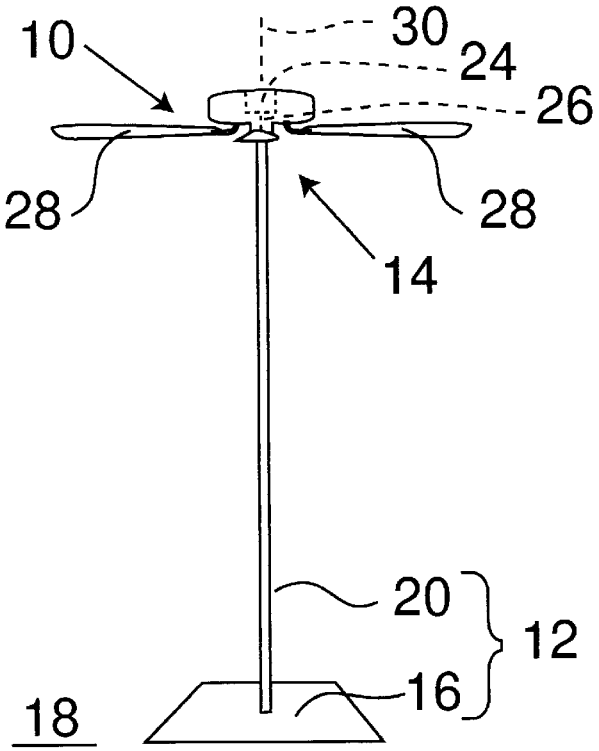
FIG. 1 is a front view of a free-standing overhead fan apparatus in accordance with one embodiment of the invention.

FIG. 1 illustrates a free-standing overhead fan apparatus 10 in accordance with one embodiment of the invention. The fan apparatus 10 includes a stand 12 and a fan 14 mounted on the stand 12. The stand 12 includes a base 16 positioned on a floor or ground level 18 and an elongated member 20 extending upwardly from the base 16. The fan 14 is mounted at the upper end of the elongated member 20, preferably about seven feet above ground level 18. This distance has been found to be suitable for limiting human contact for safety reasons, yet providing effective air flow to users of the device 10.

The fan 14 includes a housing 22 containing an electric motor 24 and a rotating shaft 26 extending from the motor 24. The fan 14 also includes at least one fan blade or vane 28 radially extending from the motor shaft 26. (The fan 14 shown in FIG. 1 includes four vanes 28.) The fan 14 is mounted on the stand 12 such that the motor shaft 26 and fan blades 28 are rotatable about a vertical axis 30 to emulate a ceiling fan.

The electric motor 24 is reversible, i.e., the motor shaft 26 can selectively be rotated in both directions. The fan blades 28 are configured such that when the shaft 26 rotates in one direction, air is directed downwardly from the fan blades 28, and when the shaft 26 is rotated in the other direction, airflow is directed in the opposite direction.

The fan apparatus 10 is fully portable and can be moved from room to room. It can also be used outdoors since no ceiling is required. The fan apparatus 10 is thus portable, yet provides all the advantages of a ceiling fan.

Figure 2:
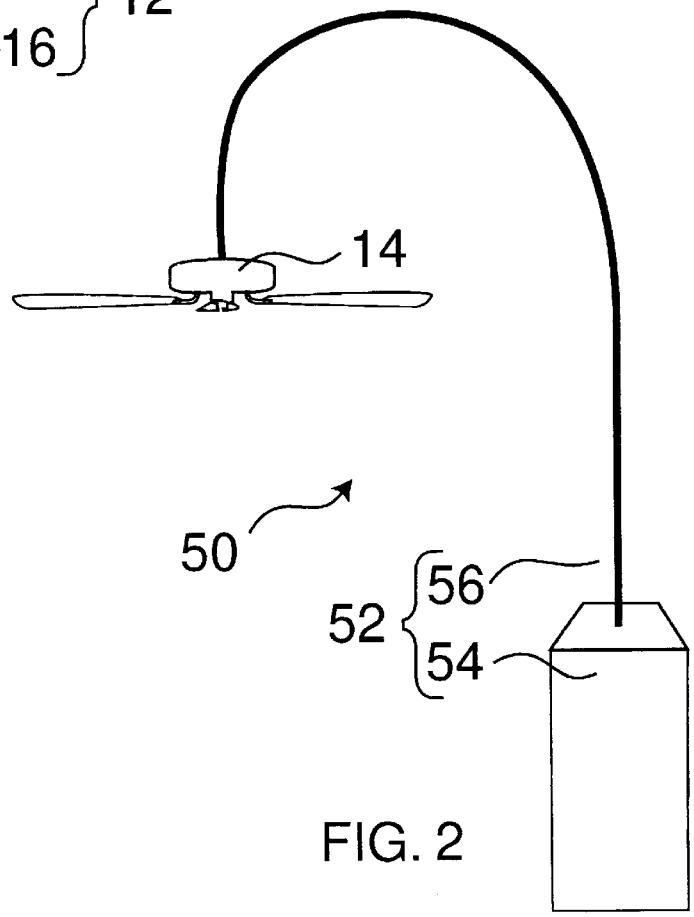
FIG. 2 is a side view of a free-standing overhead fan apparatus in accordance with another embodiment of the invention.

The stand 12 of the fan apparatus 10 can have a variety of configurations. For example, FIG. 2 shows a free-standing overhead fan apparatus 50 in accordance with another embodiment of the invention having a stand 52 comprising a base 54 and an elongated member 56 that is partly U-shaped. This design allows the base 54 of the stand 52 to be positioned away from the area directly beneath the fan 14, which may be desired in some applications.

Figure 3:
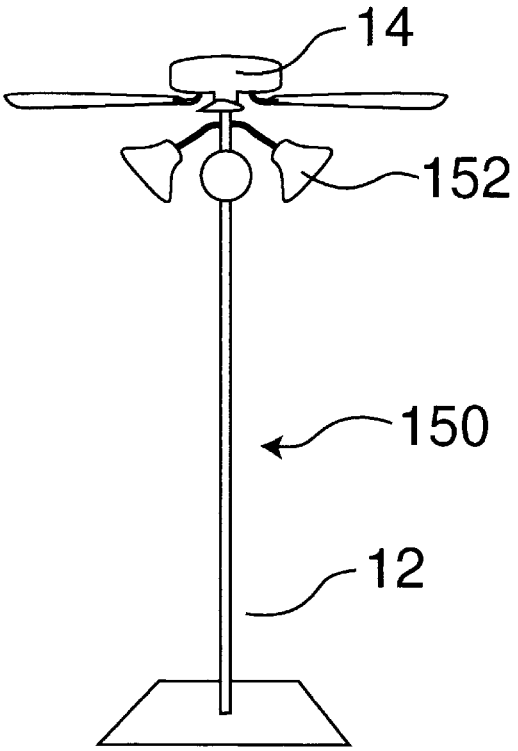
FIG. 3 is a front view of a free-standing overhead fan apparatus in accordance with another embodiment of the invention.
Figure 4:
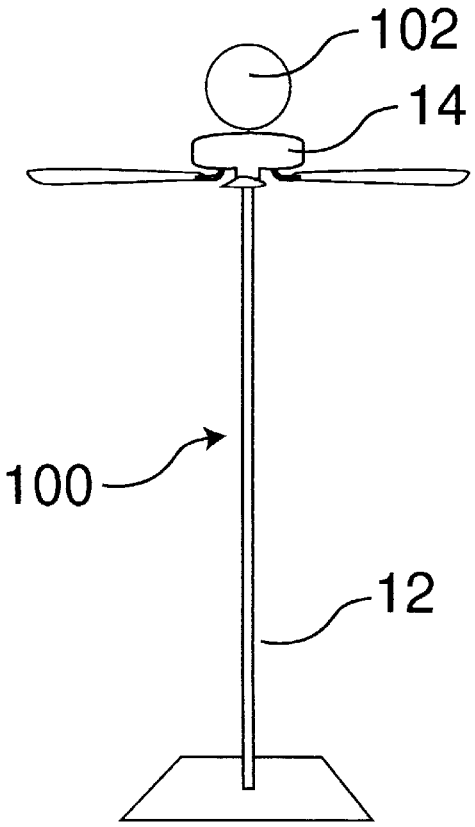
FIG. 4 is a front view of a free-standing overhead fan apparatus in accordance with another embodiment of the invention.

The fan apparatus of the present invention may also include lighting, making it particularly suitable for use at night or in darkly lit places. For example, FIG. 3 illustrates a fan apparatus 100 with a light 102 mounted above the fan 14. Also, FIG. 4 illustrates a fan apparatus 150 having a light fixture 152 with a set of three lights mounted below the fan 14.

Figure 6:
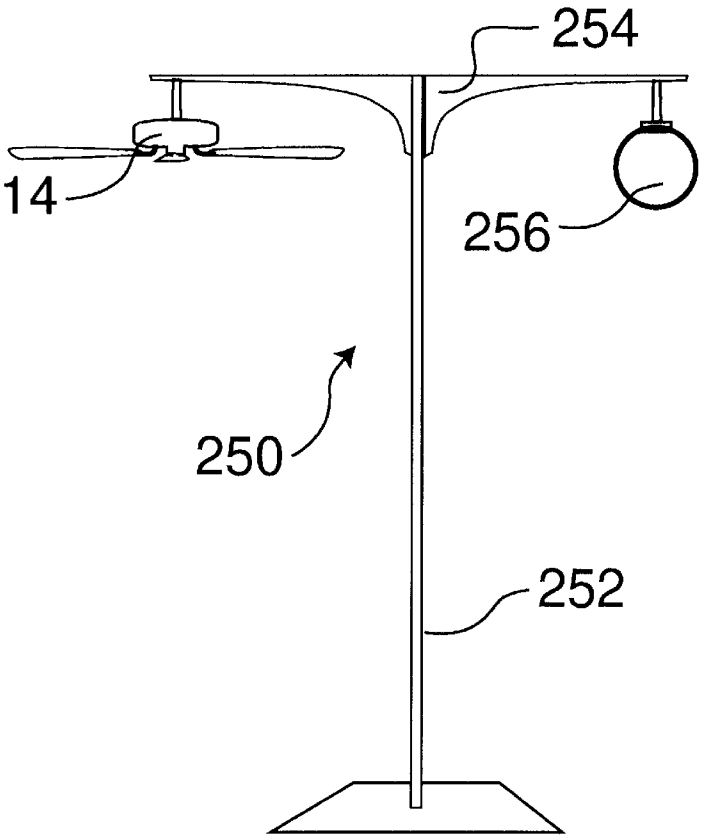
FIG. 6 is a front view of a free-standing overhead fan apparatus in accordance with another embodiment of the invention.
Figure 5:
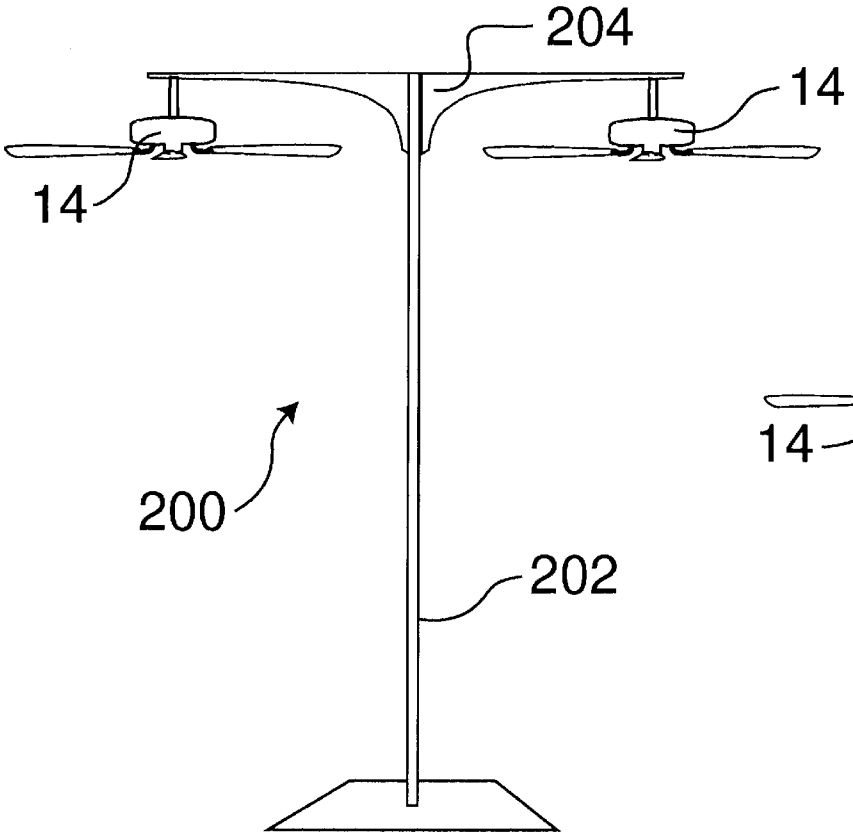
FIG. 5 is a front view of a free-standing overhead fan apparatus in accordance with another embodiment of the invention.

The stand can also be configured for holding more than one fan. For example, FIG. 5 illustrates a fan apparatus 200 having a stand 202 with a horizontally extending bracket 204 supporting two fans 14. In FIG. 6, a fan apparatus 250 in accordance with another embodiment of the invention is shown in which the stand 252 includes a horizontally extending bracket 254 supporting a fan 14 at one end and a light 256 at another end.

Figure 7:
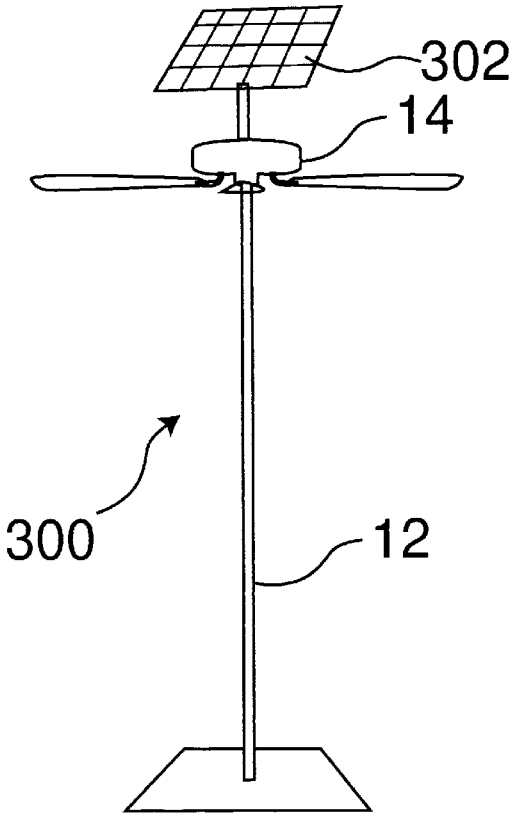
FIG. 7 is a front view of a free-standing overhead fan apparatus in accordance with another embodiment of the invention.
Figure 8:
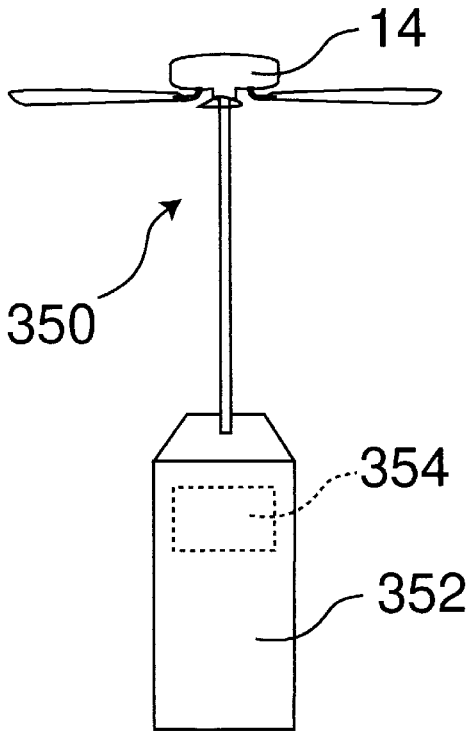
FIG. 8 is a front view of a free-standing overhead fan apparatus in accordance with another embodiment of the invention.

FIGS. 7 and 8 illustrate embodiments of the invention particularly suitable for use in areas without readily accessible electric power such as, for example, at remote camping sites, at beach resorts, and with campers. FIG. 7 illustrates a free-standing overhead fan apparatus 300 comprising a solar panel device 302 for powering the fan 14. FIG. 8 illustrates a free-standing overhead fan apparatus 350 including an enlarged base 352 designed to house a rechargeable battery 354 for powering the fan 14.

Figure 9:
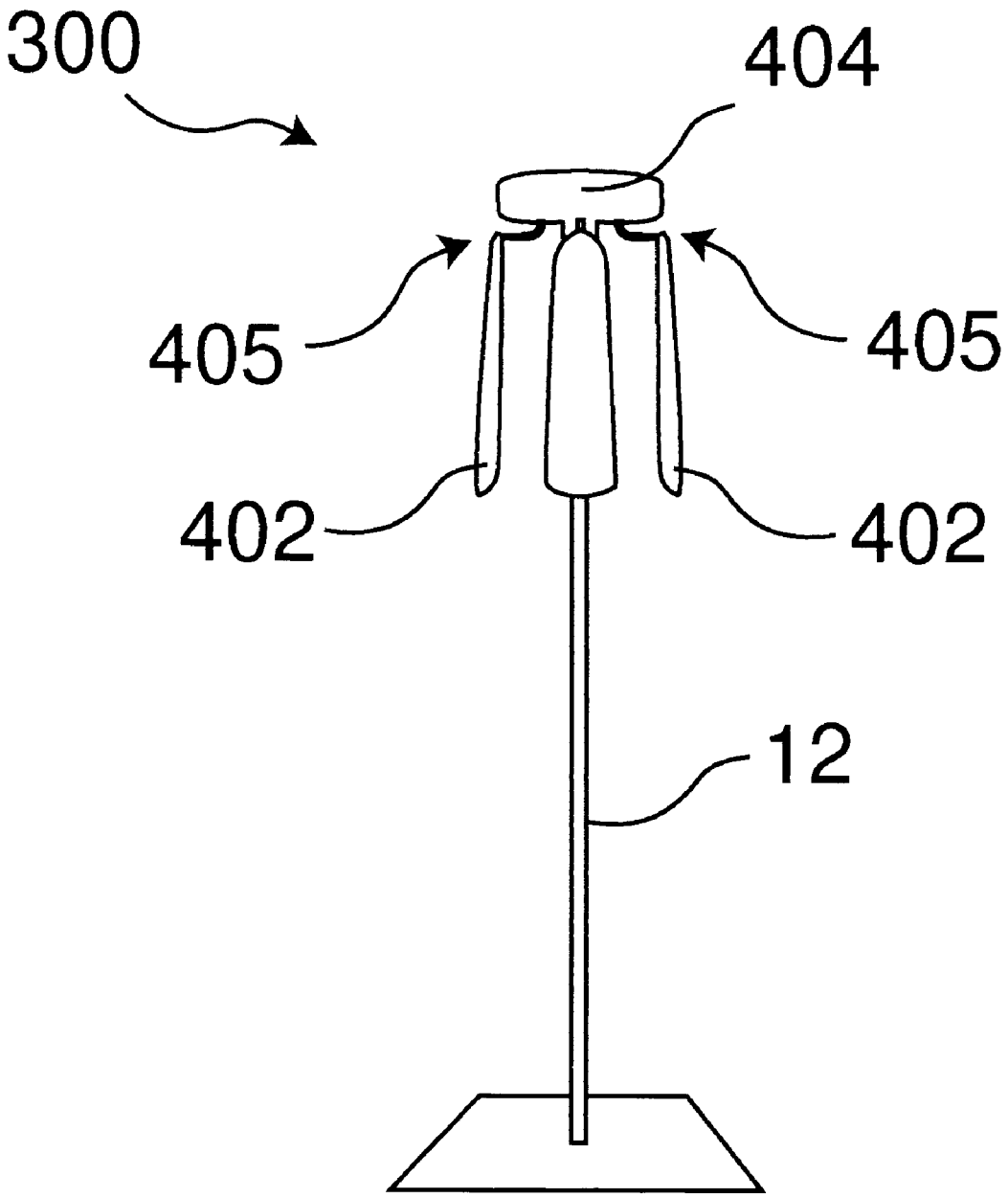
FIG. 9 is a front view of a free-standing overhead fan apparatus in accordance with another embodiment of the invention.

FIG. 9 illustrates a free-standing overhead fan apparatus 400 in which the fan blades 402 are pivotally connected to the motor shaft in the fan housing 404. Accordingly, the blades 402 can be collapsed as shown when not in use. This embodiment of the invention is particularly useful for fans used outdoors to limit exposure of the fan to inclement weather and for storage.

Figure 10:
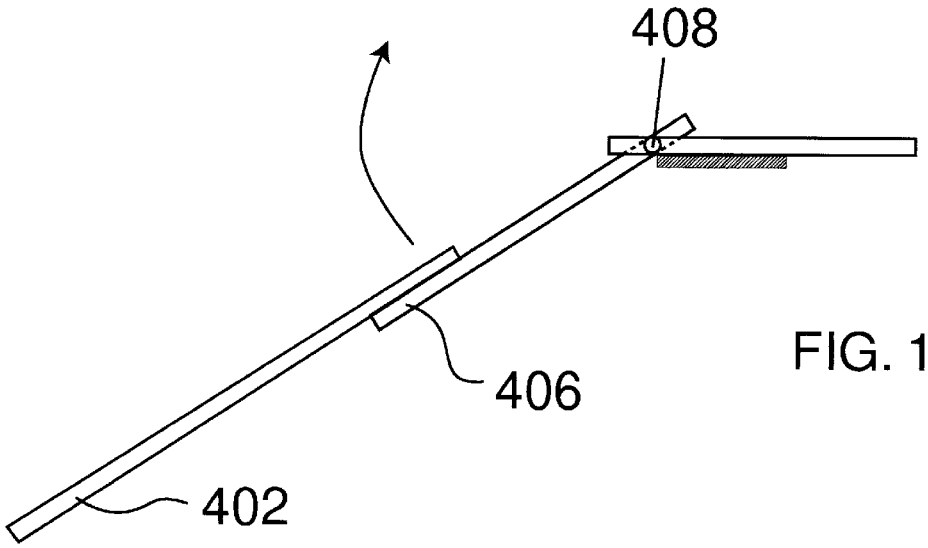
FIG. 10 is an enlarged side view of the locking hinge mechanism of the collapsible fan blades shown in FIG. 9.
Figure 11:
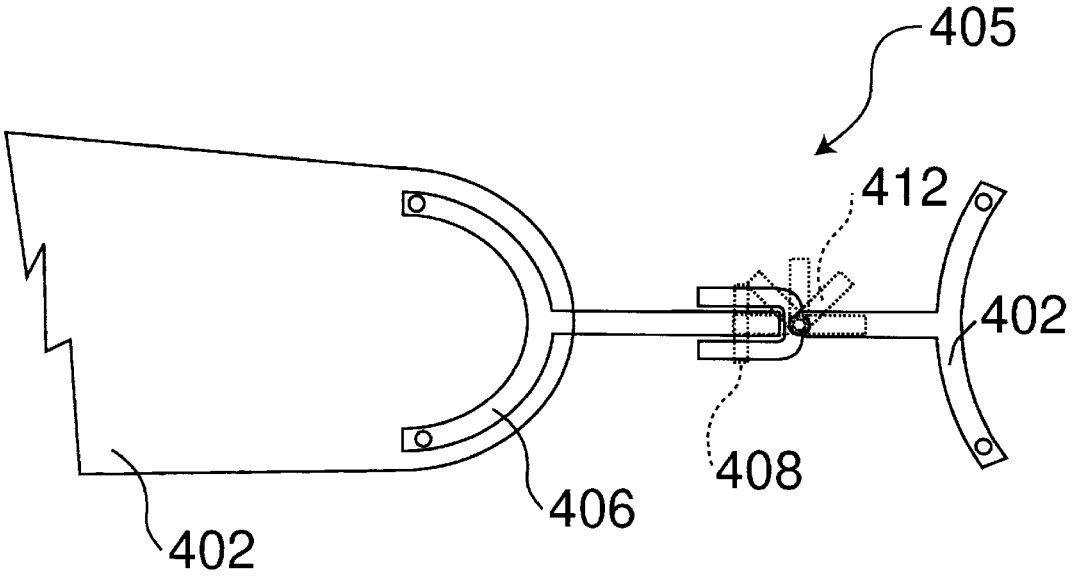
FIG. 11 is an enlarged bottom view of the locking hinge mechanism.

FIGS. 10 and 11 illustrate the locking hinge mechanism 405 of the collapsible fan blades shown in FIG. 9. As shown, a member 406 fixedly connected to a fan blade 402 is pivotally connected about a hinge pin 408 to a member 410 fixedly connected to the motor shaft (not shown). A locking tab 412 can be moved to lock the fan blade 402 in an extended use position.

Figure 12:
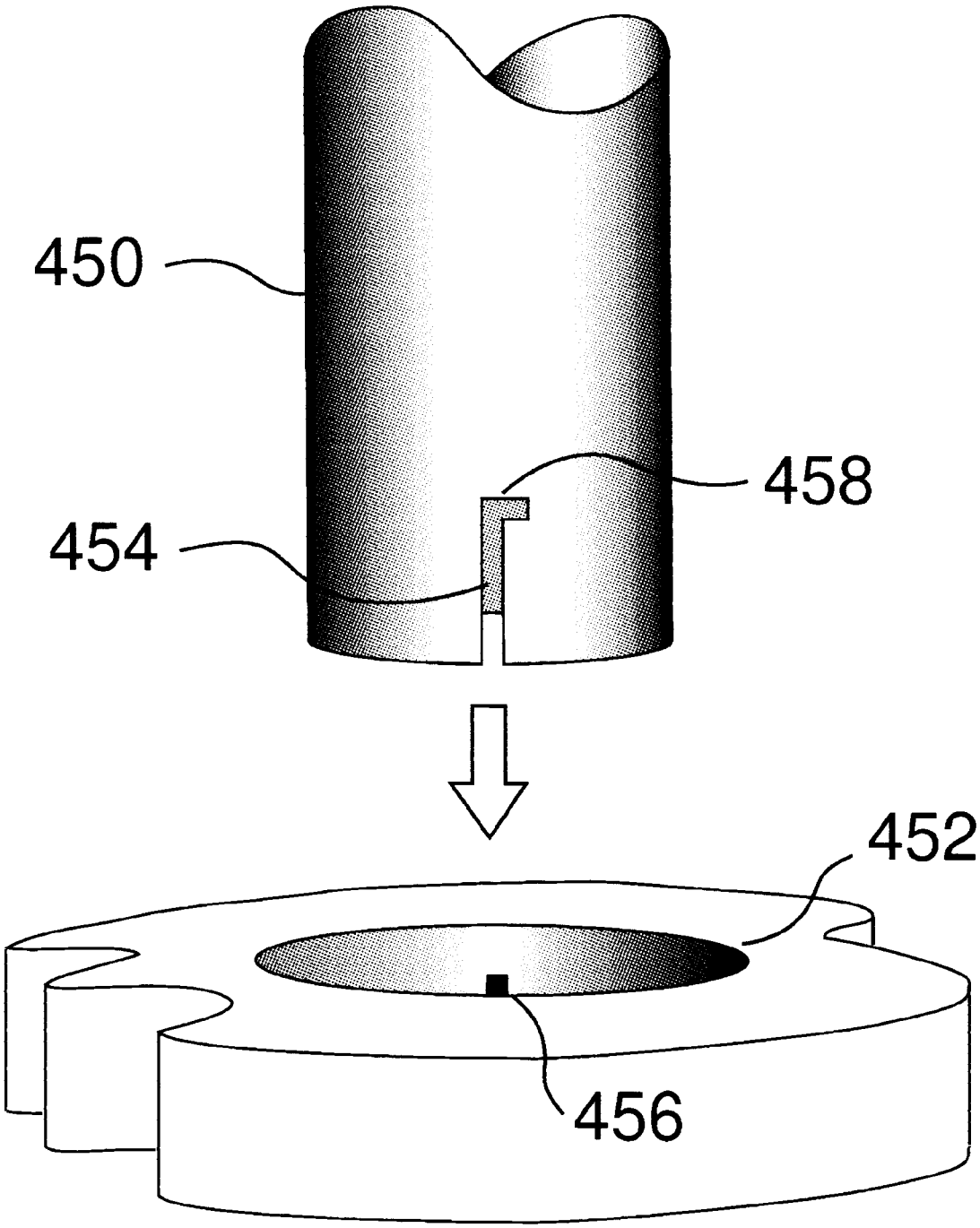
FIG. 12 is an enlarged view of the twist-and-lock mechanism of a free-standing overhead fan apparatus in accordance with another embodiment of the invention.

FIG. 12 shows a further embodiment of the invention, in which a fan apparatus includes an elongated member 450 that is not fixedly attached to a base structure. To increase portability, the elongated member 450 can be removably mounted in remotely located fixed sockets 452. The sockets 452 can, for example, be located in a patio or a deck. The member 450 and the socket 452 include a twist-to-lock mechanism for coupling the parts. The member 450 includes a slot 454 for receiving a pin 456 projecting into the socket 452. The upper end of the slot 454 includes a horizontal portion 458 for receiving the pin 456 when the elongated member 450 is twisted in a locked position. Fan apparatus in accordance with this embodiment can be quickly and easily set up or taken down as desired. They would be particularly useful in outdoor cafes, for example, where they may have to be moved quickly in case of inclement weather or rearranged to provide more or fewer fans in certain areas as desired.

Figure 13:
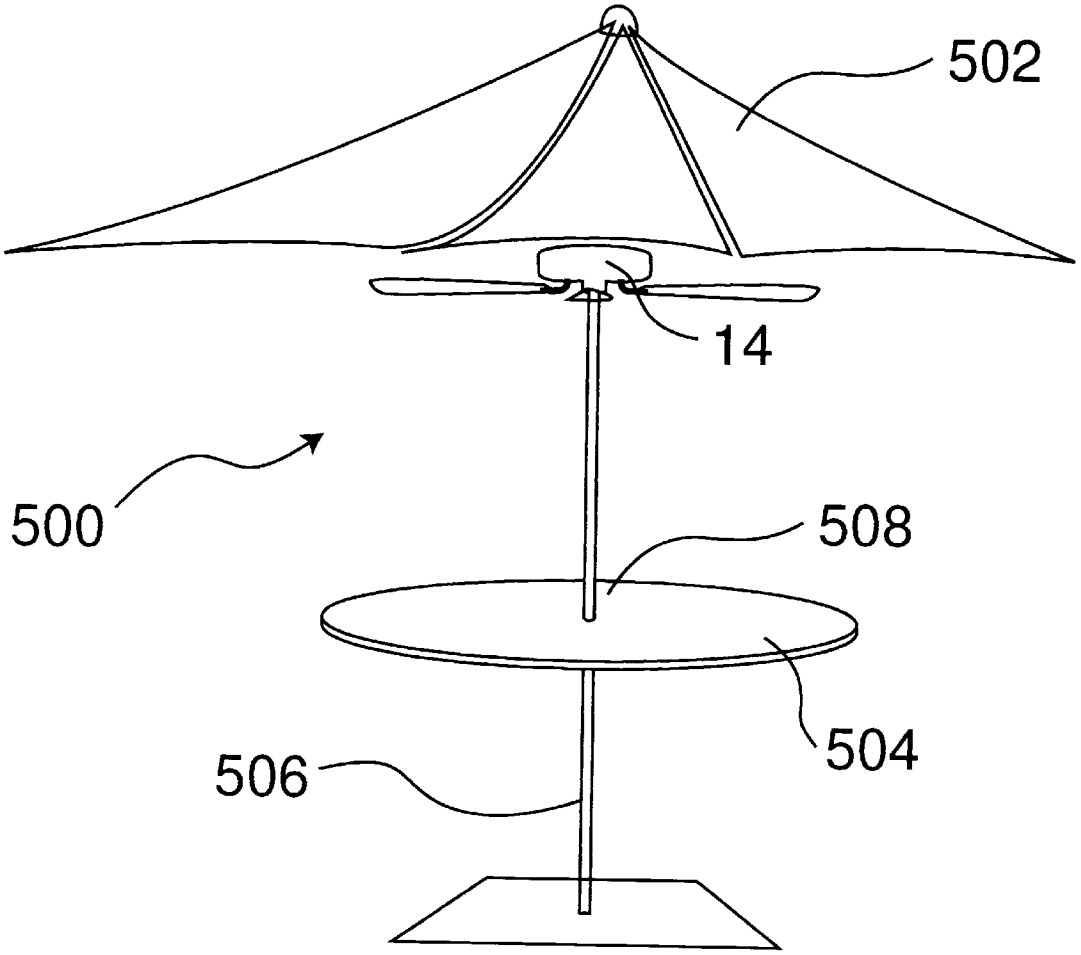
FIG. 13 is a front view of a free-standing overhead fan apparatus in accordance with another embodiment of the invention.

FIG. 13 illustrates a free-standing overhead fan apparatus 500 that is particularly suitable for outdoor use. The fan apparatus 500 further includes an umbrella 502 mounted above the fan 14 for reducing exposure to sunshine or rain. The fan 14 provides effective air circulation under the umbrella 502.

The FIG. 13 embodiment also includes a tabletop 504 mounted on the stand 506. The tabletop 504 includes a throughhole 508 at the center thereof through which the elongated member of the stand 506 extends.

Thus, fans in accordance with the invention provide the advantages of ceiling fans, yet are fully portable and usable in places impractical or impossible for ceiling fans.

It should be appreciated by those skilled in the art that the specific embodiments disclosed above may be readily utilized as a basis for modifying or designing other devices for carrying out the purposes of the present invention. It should also be realized by those skilled in the art that such equivalent constructions do not depart from the spirit and scope of the invention as set forth in the appended claims.

We claim:

1. A free-standing overhead fan apparatus, comprising:

stand; and fan mounted on said stand rotatable about a substantially vertical axis to emulate a ceiling fan, said fan comprising:

a motor;

a shaft extending from said motor rotatable about said vertical axis;

at least one vane extending radially from said shaft, said at least one vane being attached to said shaft via a hinge that allows vertical movement of said vane; and a locking tab pivotably attached to said shaft, that in a first position allows said vane to rotate freely about said hinge, and in a second position holds said at least one vane in a horizontal position when said locking tab is locked in place.

2. The free-standing overhead fan apparatus of claim 1, wherein said motor is electrically powered.

3. The free-standing overhead fan apparatus of claim 1, further comprising a solar panel device for powering said motor.

4. The free-standing overhead fan apparatus of claim 1, further comprising a rechargeable battery for powering said motor.

5. The free-standing overhead fan apparatus of claim 1, wherein said at least one vane is collapsible for storage and to limit exposure to weather elements.

6. The free-standing overhead fan apparatus of claim 1, wherein said stand is positionable on a given level, and said fan is mounted on said stand a given distance above the given level.

7. The free-standing overhead fan apparatus of claim 1, wherein said stand comprises a base and an elongated member extending from said base, and wherein said fan is mounted on said elongated member.

8. The free-standing overhead fan apparatus of claim 7, wherein said elongated member is at least partly U-shaped.

9. The free-standing overhead fan apparatus of claim 1, wherein stand comprises an elongated member, and wherein said fan is mounted on one end of said member, and an opposite end of said member is removably mountable in a remote socket designed to receive said member.

10. The free-standing overhead fan apparatus of claim 9, wherein said elongated member and said socket include a locking mechanism to releasably lock said elongated member in said socket.

11. The free-standing overhead fan apparatus of claim 1, further comprising an umbrella mounted above said fan.

12. The free-standing overhead fan apparatus of claim 1, further comprising a light source mounted on said fan.

13. The free-standing overhead fan apparatus of claim 1, further comprising a tabletop affixed to said stand.

14. A fan device positionable on a given surface for emulating a ceiling fan, comprising:

an electric fan including an electric motor having a shaft and a plurality of fan blades extending radially from and rotatable by said motor about a substantially vertical axis, said fan blades being attached to said shaft via a hinge that allows vertical movement of said vane, each hinge including a locking tab pivotably attached to said shaft, that in a first position allows said vane to rotate freely about said hinge, and in a second position holds the respective one of said fan blades in a horizontal position when said locking tab is locked in place; and a stand for supporting the electric fan a given distance above the given surface.

15. The fan device of claim 14, further comprising a solar panel device for powering said motor.

16. The fan device of claim 14, further comprising a rechargeable battery for powering said motor.

17. The fan device of claim 14, wherein said stand comprises a base and an elongated member extending from said base, and wherein said fan is mounted on said elongated member.

18. The fan device of claim 14, wherein stand comprises an elongated member, and wherein said fan is mounted on one end of said member, and an opposite end of said member is removably mountable in a remote socket designed to receive said member.

* * * * *